US011530603B2

(12) United States Patent
Gates et al.

(10) Patent No.: US 11,530,603 B2
(45) Date of Patent: Dec. 20, 2022

(54) IN-SITU PROCESS TO PRODUCE HYDROGEN FROM UNDERGROUND HYDROCARBON RESERVOIRS

(71) Applicant: Proton Technologies Inc., Road Town (VG)

(72) Inventors: Ian D. Gates, Calgary (CA); Jingyi Wang, Calgary (CA)

(73) Assignee: Proton Technologies Inc., Tortola (VG)

( * ) Notice: Subject to any disclaimer, the term of this patent is extended or adjusted under 35 U.S.C. 154(b) by 502 days.

(21) Appl. No.: 16/076,277

(22) PCT Filed: Feb. 7, 2017

(86) PCT No.: PCT/CA2017/050135

§ 371 (c)(1),
(2) Date: Aug. 7, 2018

(87) PCT Pub. No.: WO2017/136924

PCT Pub. Date: Aug. 17, 2017

(65) Prior Publication Data

US 2021/0189856 A1 Jun. 24, 2021

Related U.S. Application Data

(60) Provisional application No. 62/292,556, filed on Feb. 8, 2016.

(51) Int. Cl.
*E21B 43/295* (2006.01)
*E21B 43/08* (2006.01)
(Continued)

(52) U.S. Cl.
CPC ..... *E21B 43/295* (2013.01); *E21B 43/08* (2013.01); *E21B 43/243* (2013.01); *E21B 43/38* (2013.01)

(58) Field of Classification Search
CPC ..... E21B 36/00; E21B 43/08; E21B 43/16; E21B 43/24; E21B 43/2401; E21B 43/2403; E21B 43/2405; E21B 43/2406; E21B 43/243; E21B 43/25; E21B 43/28; E21B 43/281; E21B 43/295
See application file for complete search history.

(56) References Cited

U.S. PATENT DOCUMENTS 7,431,084 B1 * 10/2008 Upadhye ..... E21B 43/38 166/265
2003/0080604 A1 * 5/2003 Vinegar ..... E21B 43/30 299/14

(Continued)

FOREIGN PATENT DOCUMENTS

WO 2008033268 3/2008
WO 2008051495 5/2008

OTHER PUBLICATIONS

International Search Report for PCT/CA2017/050135, Completed by the Canadian Patent Office dated Apr. 21, 2017, 3 Pages.

*Primary Examiner* — Tara Schimpf
(74) *Attorney, Agent, or Firm* — Brooks Kushman P.C.

(57) ABSTRACT

A hydrocarbon reservoir is treated with heat to induce gasification, water-gas shift, and/or aquathermolysis reactions to generate gases including hydrogen. The hydrogen alone is produced to the surface by using hydrogen-only membranes in the production wells.

11 Claims, 17 Drawing Sheets

(51) Int. Cl.
*E21B 43/243* (2006.01)
*E21B 43/38* (2006.01)

(56) References Cited

U.S. PATENT DOCUMENTS

2003/0178191 A1* 9/2003 Maher ..... E21B 36/001
166/65.1
2008/0289820 A1* 11/2008 De Francesco ..... C10G 1/047
166/257
2008/0296018 A1* 12/2008 Zubrin ..... C10G 1/04
166/267
2012/0138316 A1* 6/2012 Matzakos ..... E21B 43/16
166/400
2015/0247818 A1* 9/2015 Silvester ..... E21B 49/08
205/793
2019/0017358 A1* 1/2019 Morse ..... E21B 43/243
2020/0182019 A1* 6/2020 Wang ..... E21B 43/38

* cited by examiner

Case A

IN-SITU PROCESS TO PRODUCE HYDROGEN FROM UNDERGROUND HYDROCARBON RESERVOIRS

CROSS-REFERENCE TO RELATED APPLICATION

This application is the U.S. national phase of PCT Application No. PCT/CA2017/050135 filed on Feb. 7, 2017, which claims the benefit to U.S. Provisional Patent Application No. 62/292,556 filed on Feb. 8, 2016, the disclosures of which are incorporated in their entirety by reference herein.

FIELD OF THE INVENTION

The present invention relates to the production of hydrogen from subsurface sources.

BACKGROUND OF THE INVENTION

Hydrocarbon reservoirs are abundant globally and many technologies are known for use in the production of hydrocarbon to surface from these reservoirs, including primary processes as well as secondary recovery processes such as water flooding and chemical flooding to produce additional hydrocarbon.

For heavy oil and extra heavy oil (bitumen), the hydrocarbon is usually too viscous at original reservoir conditions to be produced to surface using conventional methods, and so heavy oil and bitumen are commonly thermally treated to lower the viscosity so that the resource flows more easily in the reservoir and can be produced to the surface.

After heavy oil and bitumen is extracted, it has to be upgraded to synthetic crude oil which in turn is refined into transportation fuels and feedstocks for the petrochemical industry.

However, it is known that the production of hydrocarbon resources results in eventual generation of carbon dioxide since the resources or their products are generally combusted to harvest their energy.

There is thus an ongoing desire to produce fuels such as hydrogen that are more carbon dioxide neutral, which can also be used as chemical feedstock for industries such as upgraders and fertilizer production. However, conventional means of generating hydrogen (e.g., steam methane reforming or electrolysis) are also known to be carbon-intensive or undesirably expensive to implement.

SUMMARY OF THE INVENTION

The present invention therefore seeks to provide methods and systems for generating hydrogen, a potentially carbon dioxide neutral energy source and industrial feedstock, from hydrocarbon reservoirs.

According to embodiments of the present invention, in situ gasification, water-gas shift and/or aquathermolysis are employed to produce synthesis gas in the subsurface reservoir, such synthesis gas comprising steam, carbon monoxide, carbon dioxide, and hydrogen, where the carbon oxides are rejected from being produced to the surface by means of a hydrogen-only permeable membrane in the wellbore. The process then produces a gas product largely comprising hydrogen to the surface.

The produced hydrogen is an alternative energy vector that can be produced to the surface from hydrocarbon reservoirs. The produced hydrogen can then be combusted on surface to generate power or heat or consumed in fuel cell devices for production of power or as an industrial feedstock.

In a first broad aspect of the present invention, there is provided a method for producing hydrogen from a hydrocarbon reservoir, the method comprising:

a. providing a well from surface to the reservoir;

b. locating at least one hydrogen-permeable membrane in the well;

c. heating the reservoir to facilitate at least one of gasification, water-gas shift, and aquathermolysis reactions to occur between hydrocarbon and water within the reservoir to generate a gas stream comprising hydrogen; and d. engaging the gas stream and the at least one hydrogen-permeable membrane, such that the at least one hydrogen-permeable membrane permits passage of only the hydrogen in the gas stream to the surface.

In some exemplary embodiments of the first aspect, the step of heating the reservoir comprises: injecting an oxidizing agent into the reservoir to oxidize at least some of the hydrocarbon within the reservoir; generating electromagnetic or radio-frequency waves with an electromagnetic or radio-frequency antenna placed within the reservoir; injecting a hot material into the reservoir; or generating heat by using a resistance-based (ohmic) heating system located within the reservoir. It will be clear to those skilled in the art that other heating means may be applicable for applications of the present invention.

In some exemplary embodiments, the at least one hydrogen-permeable membrane may comprise at least one of: palladium (Pd), vanadium (V), tantalum (Ta) or niobium (Nb). The at least one hydrogen-permeable membrane may also comprise a palladium-copper alloy, or potentially a palladium-silver alloy. The at least one hydrogen-permeable membrane may comprise a ceramic layer, and most preferably a ceramic layer on the inside or the outside of a palladium-copper alloy. The at least one hydrogen-permeable membrane may comprise a ceramic layer and a non-ceramic layer selected from the group consisting of palladium, vanadium, tantalum, niobium, copper, alloys of these materials, and combinations thereof, and the non-ceramic layer may comprise a palladium-copper alloy.

The at least one hydrogen-permeable membrane is preferably located in the well within the reservoir, but it may also be positioned in the well proximate to the reservoir, or at other points in the well.

In some exemplary embodiments, a porous material is located in the well to support the at least one hydrogen-permeable membrane within the well. The porous material is preferably but not necessarily porous steel.

In some exemplary embodiments of the present invention, methods comprise the further step, after the step of heating the reservoir, of delaying engaging the gas stream and the at least one hydrogen-permeable membrane to allow for further generation of the hydrogen. This step of delaying may comprise delaying for a period in the range of 1 week to 12 months, and most preferably in the range of 1 week to 4 weeks.

In exemplary embodiments where dielectric heating is used for the step of heating the reservoir, electromagnetic radiation may have a frequency in the range of about 60 Hz to 1000 GHz, and preferably in the range of 10 MHz to 10 GHz.

Where a resistance-based (ohmic) heating system is used to heat the reservoir, heating is preferably to temperatures in the range of 200 to 800 degrees C., and most preferably in the range of 400 to 700 degrees C.

In a second broad aspect of the present invention, there is provided a system for recovering hydrogen from a subsurface reservoir, the system comprising:

an apparatus for heating the reservoir to generate a gas stream comprising hydrogen;

a well located in the reservoir; and a hydrogen-permeable membrane in the well adapted to permit passage therethrough of hydrogen in the gas stream but disallow passage therethrough of other gases in the gas stream, to allow production of the hydrogen through the well to surface.

In some exemplary embodiments of the second aspect, the apparatus for heating the reservoir comprises at least one of an oxidizing-agent injector, an electromagnet, a radio-frequency antenna, and a hot material injector.

The produced hydrogen may be consumed in a fuel electrochemical cell device, combusted to generate steam for power generation or steam for oil recovery, or used as industrial feedstock.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Figure 1A:
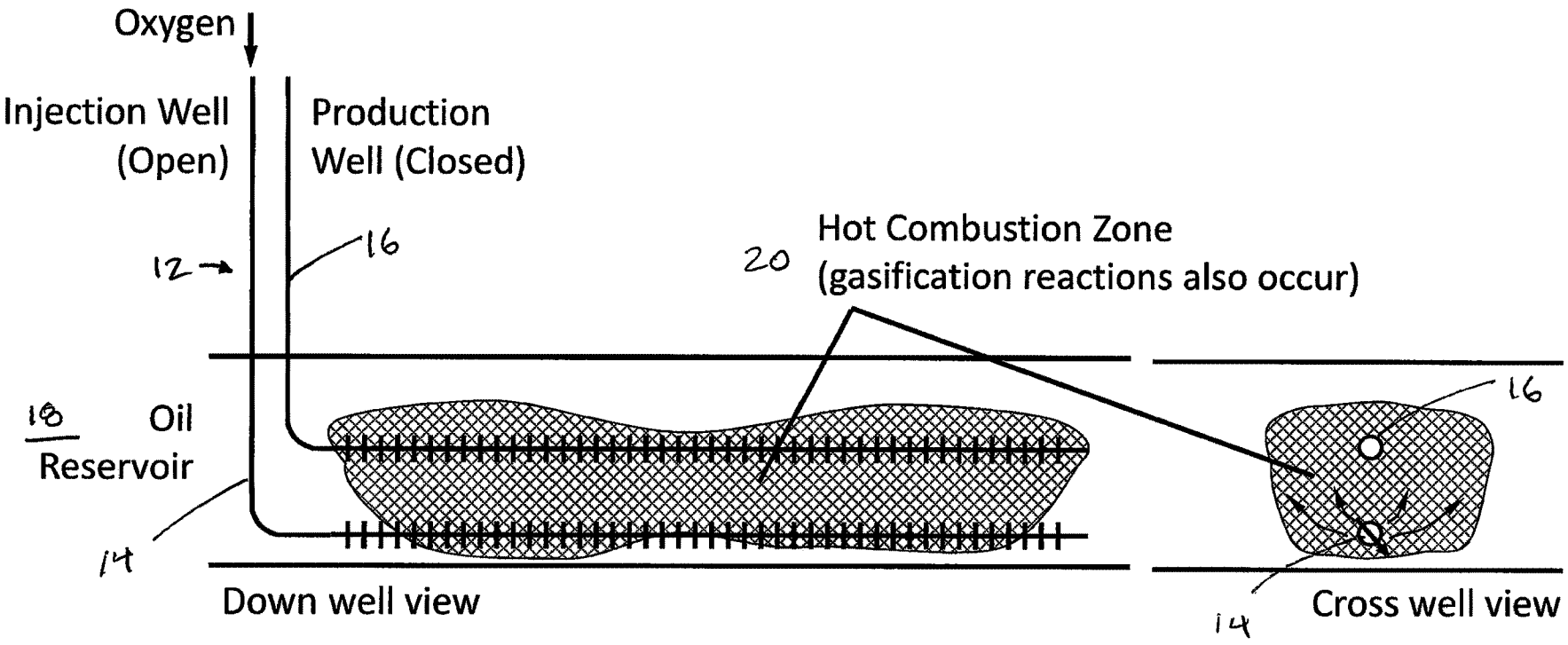
FIG. 1A to 1C are simplified elevation and sectional diagrams illustrating stages in a system and method whereby a hydrocarbon reservoir is heated by oxidizing a portion of the hydrocarbon within the reservoir.

Exemplary embodiments of the present invention will now be described with reference to the accompanying drawings.

DETAILED DESCRIPTION OF THE EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense.

Throughout this specification, numerous terms and expressions are used in accordance with their ordinary meanings. Provided below are definitions of some additional terms and expressions that are used in the description that follows.

"Oil" is a naturally occurring, unrefined petroleum product composed of hydrocarbon components. "Bitumen" and "heavy oil" are normally distinguished from other petroleum products based on their densities and viscosities. "Heavy oil" is typically classified with density of which is between 920 and 1000 kg/m3. "Bitumen" typically has density greater than 1000 kg/m3. For purposes of this specification, the terms "oil", "bitumen" and "heavy oil" are used interchangeably such that each one includes the other. For example, where the term "bitumen" is used alone, it includes within its scope "heavy oil".

As used herein, "petroleum reservoir" refers to a subsurface formation that is primarily composed of a porous matrix which contains petroleum products, namely oil and gas. As used herein, "heavy oil reservoir" refers to a petroleum reservoir that is primarily composed of porous rock containing heavy oil. As used herein, "oil sands reservoir" refers to a petroleum reservoir that is primarily composed of porous rock containing bitumen.

"Cracking" refers to the splitting of larger hydrocarbon chains into smaller-chained compounds.

The term "in situ" refers to the environment of a subsurface oil sand reservoir.

In broad aspects, the exemplary methods and systems described herein use oil sand reservoirs as a hydrogen source, both the bitumen and the formation water.

In general, the present specification describes systems and methods to treat oil reservoirs (conventional oil, heavy oil, oil sands reservoirs, carbonate oil reservoirs) to recover hydrogen. The methods include injection of oxygen or an oxygen-rich stream into the reservoir to combust a portion of the hydrocarbons in the reservoir.

In some preferred exemplary embodiments, during injection of the oxidizing agent no fluids are produced to the surface. After the target temperature is achieved in the reservoir, injection stops and during this time the remaining oxygen in the reservoir is consumed and gasification reactions and the water-gas shift reaction takes place. During these reactions, hydrogen is produced within the reservoir. The production well is completed with a hydrogen-only permeable membrane, which when opened for production only produces hydrogen to the surface. After the hydrogen production rate drops below a threshold value, oxygen injection starts once again and the process is repeated multiple times until the overall hydrogen production rate drops below a threshold value. The threshold value can be determined from a minimum hydrogen production rate that is economic which will be set by the costs of oxygen injection, price of hydrogen production, storage, transportation, and consumption (e.g., in a fuel cell for power), and the costs of operation. The hydrogen-only permeable membrane prevents the production of carbon oxides to the surface. Thus, the process yields hydrogen from the hydrocarbons and water that are situated within the reservoir. If needed to enable the desired reactions, water may be injected into the reservoir with the oxygen.

Oxidation of the reservoir fluids by injecting oxygen into the reservoir is one means to generate heat within the reservoir. The reactions that occur in the reservoir at elevated temperatures can include low and high temperature oxidation, pyrolysis (thermal cracking), aquathermolysis (hydrous pyrolysis or thermal cracking reactions in the presence of water), gasification reactions, and the water-gas shift reaction.

Figure 1B:
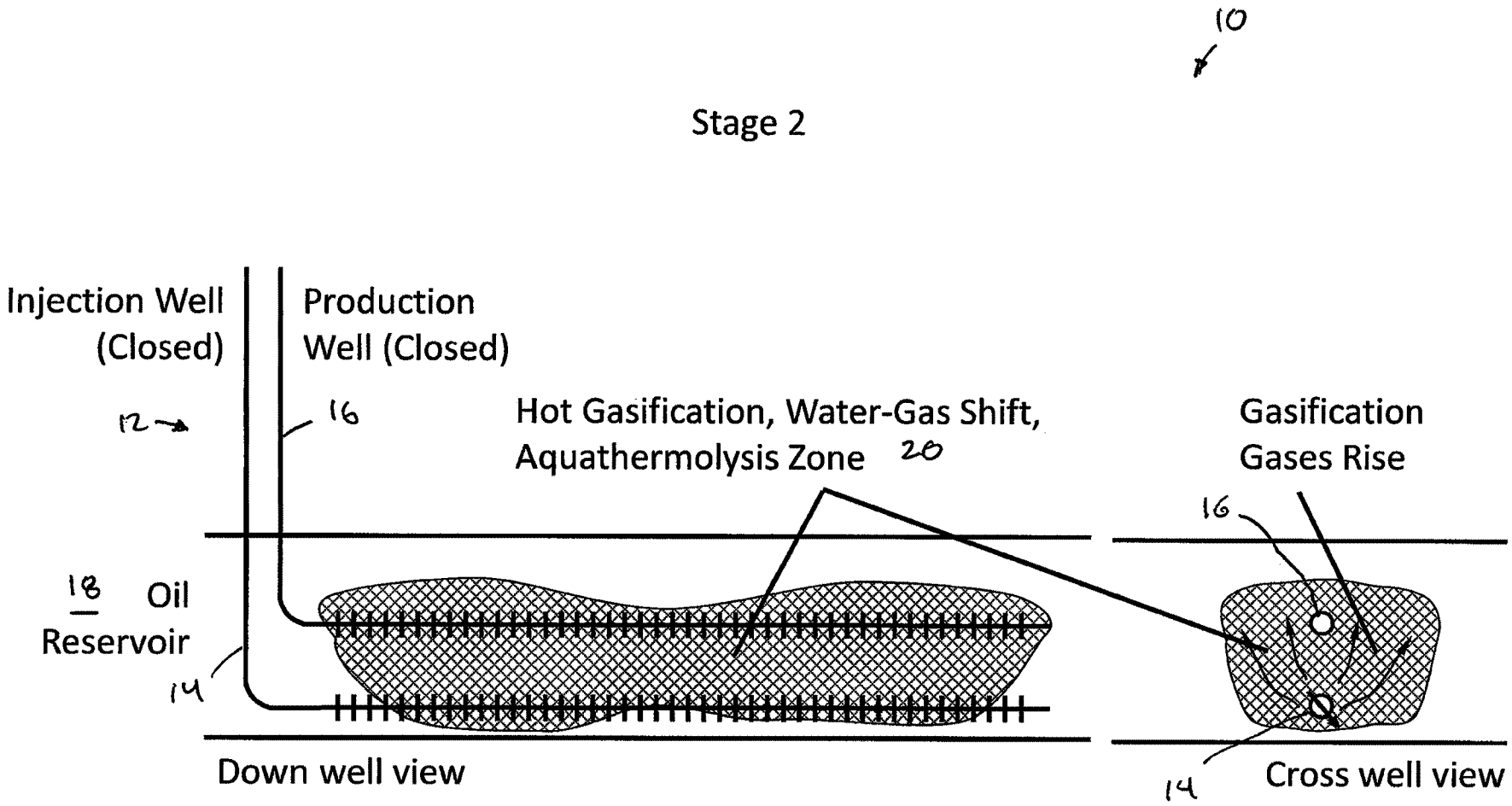
Figure 1C:
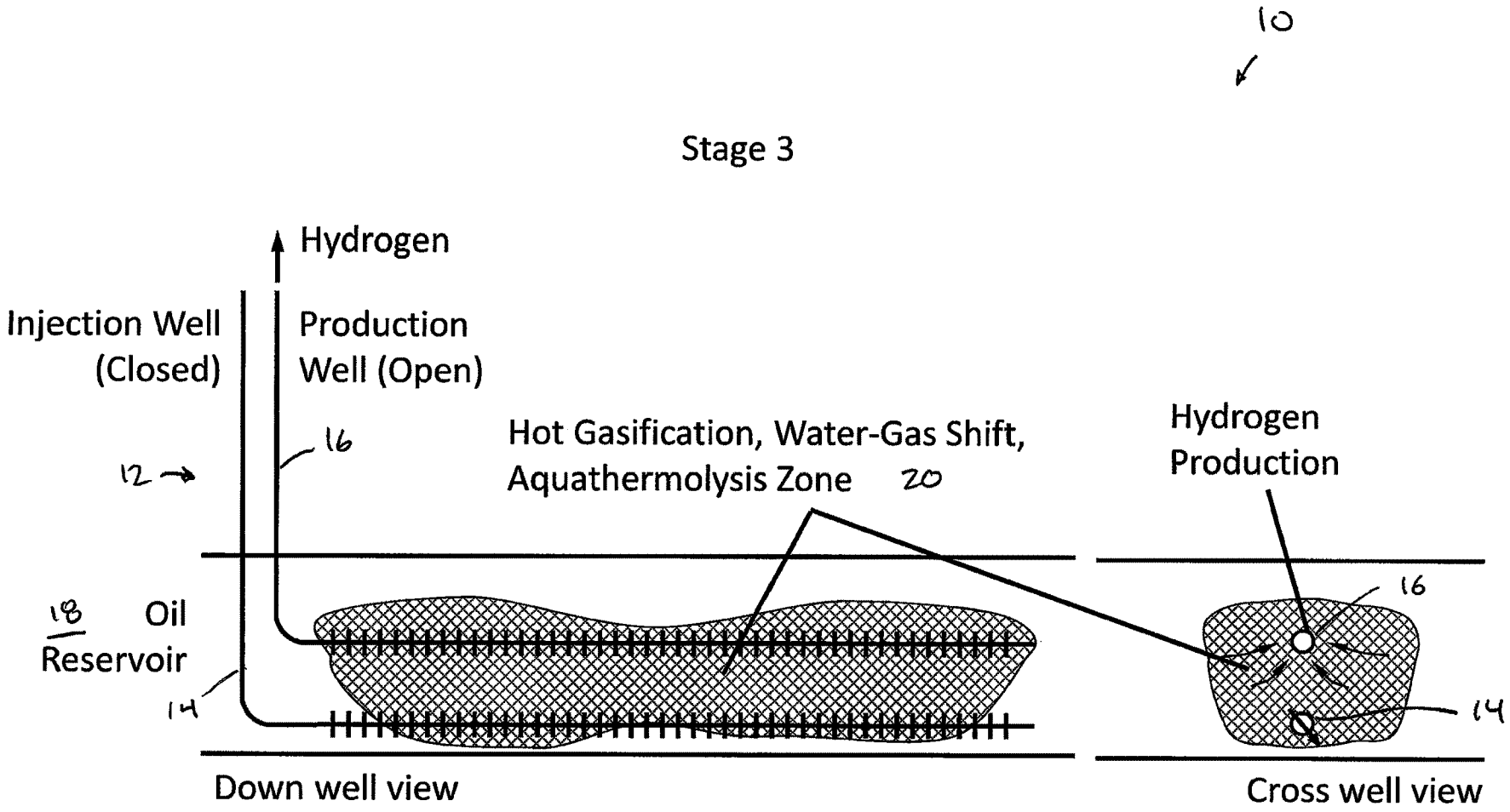

FIG. 1A to 1C illustrate a system 10 wherein a steam-assisted gravity drainage (SAGD) well pair 12 comprising an injection well 14 and a production well 16 is used for implementation of an exemplary embodiment of the present invention in a reservoir 18, over three stages. It will be clear to those skilled in the art that exemplary methods may employ an existing steam-assisted gravity drainage (SAGD) well pair or a well pair that is simply using a SAGD well configuration or pattern of SAGD well pairs, for example, a pad of SAGD well pairs. Furthermore, it will be clear to those skilled in the art that exemplary methods may employ an existing cyclic steam stimulation (CSS) well or a well that is simply using a CSS well configuration or pattern of CSS wells, for example, a pad of CSS wells. In Stage 1 (illustrated in FIG. 1A), oxygen is injected into the reservoir 18 through an open injection well 14, resulting in combustion of a portion of the bitumen in a combustion zone 20 of the reservoir 18 to generate the temperatures (for a non-limiting example, >700 degrees C.) required for the gasification, water-gas shift, and aquathermolysis reactions. The production well 16 remains closed at this stage. In Stage 2, oxygen injection is stopped and the injection well 14 is closed, and the remaining oxygen in the reservoir 18 is consumed by the ongoing reactions in the combustion zone 20. Since the reservoir 18 in the near well region is at sufficiently elevated temperatures, gasification, water-gas shift, and aquathermolysis reactions continue. The gas products from the reactions accumulate in the reservoir 18. Thereafter, Stage 3 is initiated, when the production well 16 containing the hydrogen separation membrane (not shown) is opened which then produces hydrogen to surface. After the hydrogen production has dropped to non-commercial rates, the process can then be re-started with Stage 1. The method is not limited to horizontal wells but also can be done with vertical and deviated and multilateral wells. The method can be equally applied in a gas reservoir. The method may be applied where oil is produced from the reservoir in addition to hydrogen. The method may be applied where synthesis gas is produced from the reservoir.

Figure 2:
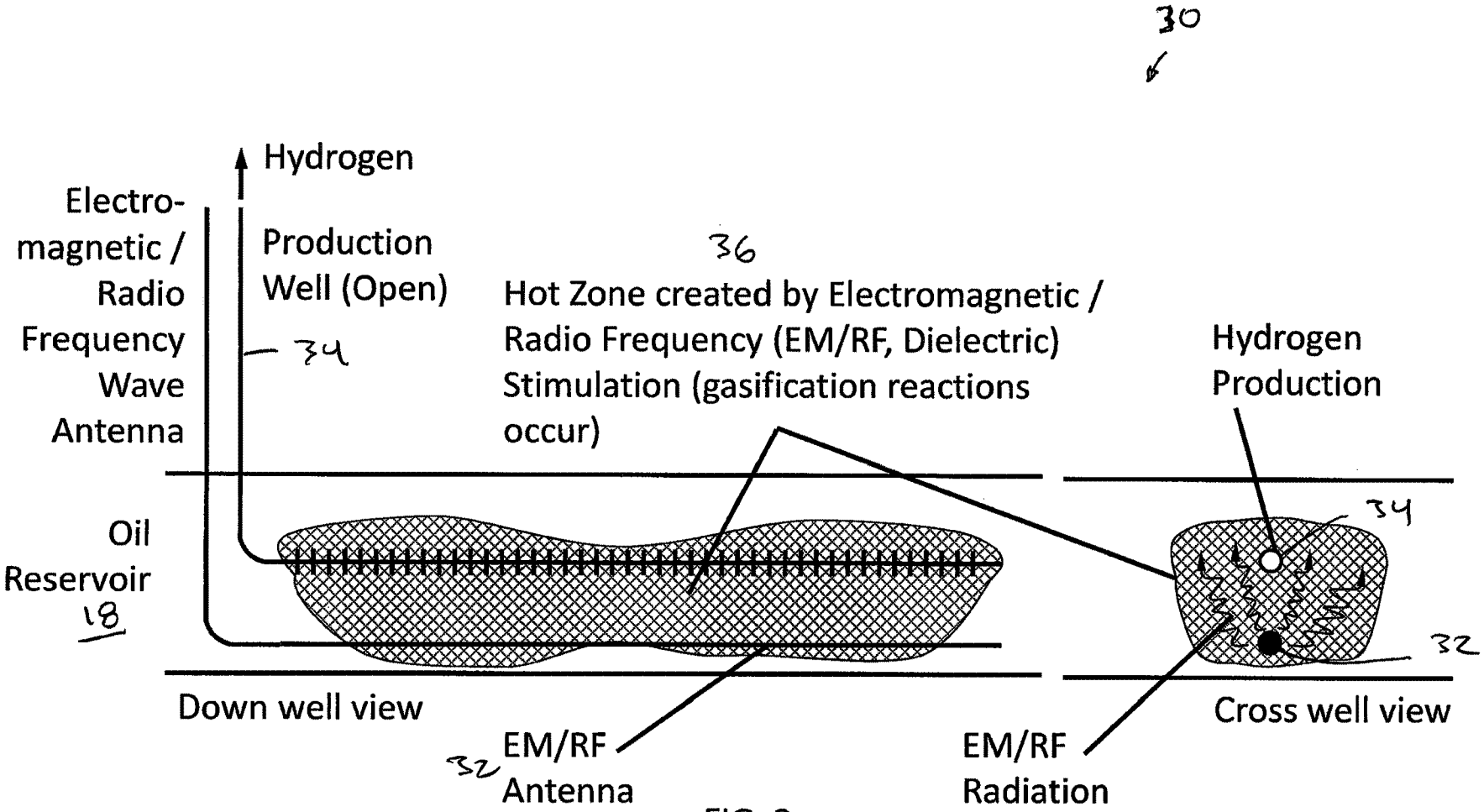
FIG. 2 is a simplified elevation and sectional diagram illustrating a system and method whereby a hydrocarbon reservoir is heated using an electromagnetic/radio frequency antenna placed within the reservoir.

Another exemplary system 30 according to the present invention is illustrated in FIG. 2. In this implementation, heat is provided to the reservoir 18 using an electromagnetic/radio frequency antenna 32 to form a heated zone 36. The heated reservoir 18 undergoes gasification, water-gas shift, and aquathermolysis reactions which generate hydrogen and other gases within the reservoir 18. The generated hydrogen is produced to the surface through the hydrogen-only permeable membrane within a production well 34. This approach is not limited to horizontal wells as illustrated but also can be done with vertical and deviated and multilateral wells. The method can be equally applied in a gas reservoir.

Figure 3:
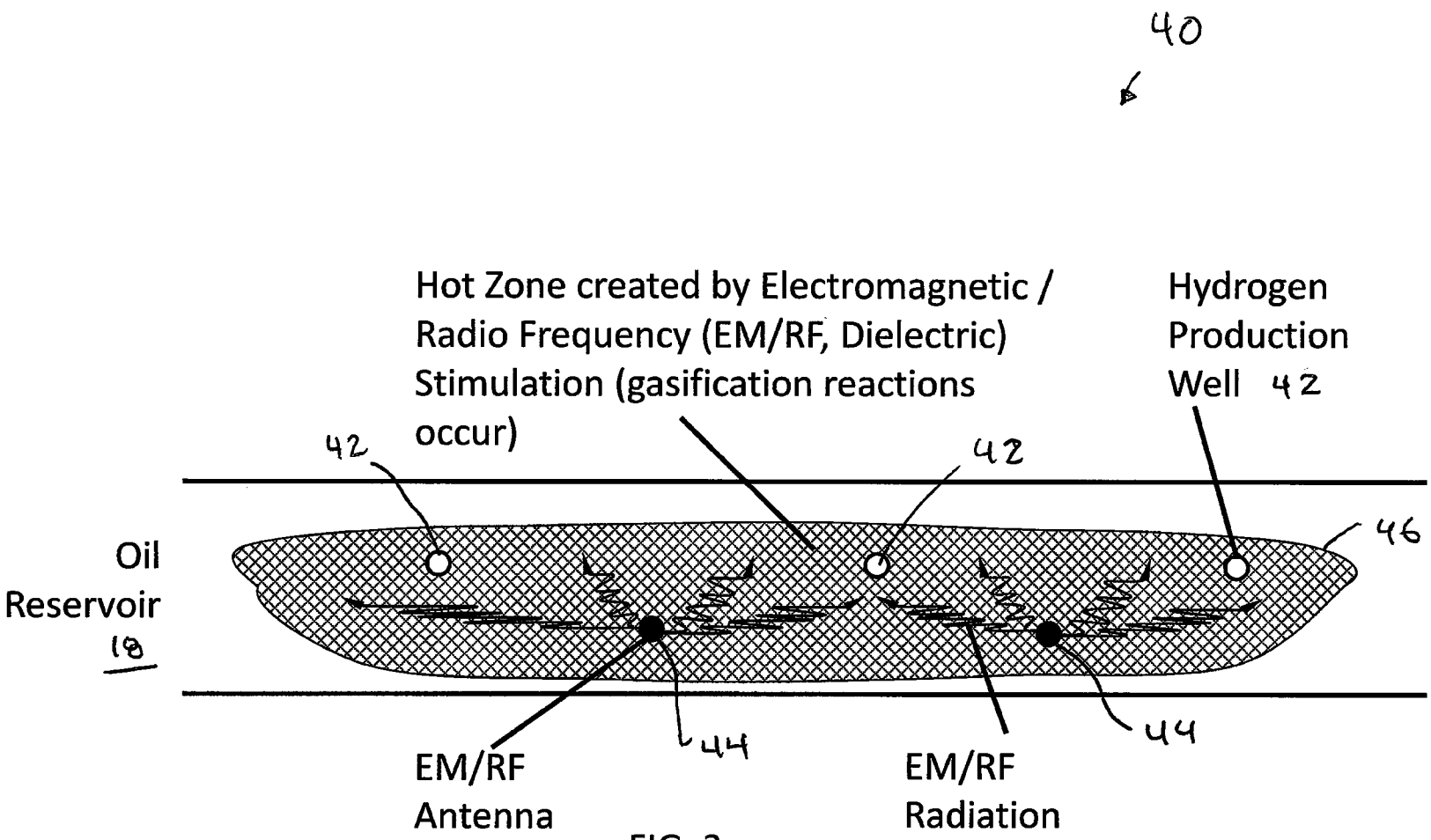
FIG. 3 is a simplified sectional diagram illustrating the use of multiple antennas and production wells.

Another related embodiment is illustrated in FIG. 3 in sectional or cross-well view, wherein a system 40 comprises multiple production wells 42 and multiple electromagnetic/radio frequency antennas/heaters 44. The electromagnetic/radio frequency heaters 44 are positioned between the hydrogen production wells 42 in the reservoir 18, and create a heated zone 46. The method is not limited to horizontal wells but also can be done with vertical and deviated and multilateral wells. The method can be equally applied in a gas reservoir. Wells with resistance (ohmic) heaters may also be used.

The reactions generate gas which then enables gravity drainage (due to density difference) of hot mobilized oil and steam condensate towards the base of the gasification reaction chamber. Thus, additional source material for further reaction is provided by moving mobilized oil towards the reactive zone above and around the injection well or antenna. This helps with gasification reactions and maintains the 700+ degrees C. zone near the well. The in-well membrane allows hydrogen to pass but holds other gas molecules in the reservoir.

Figure 5:
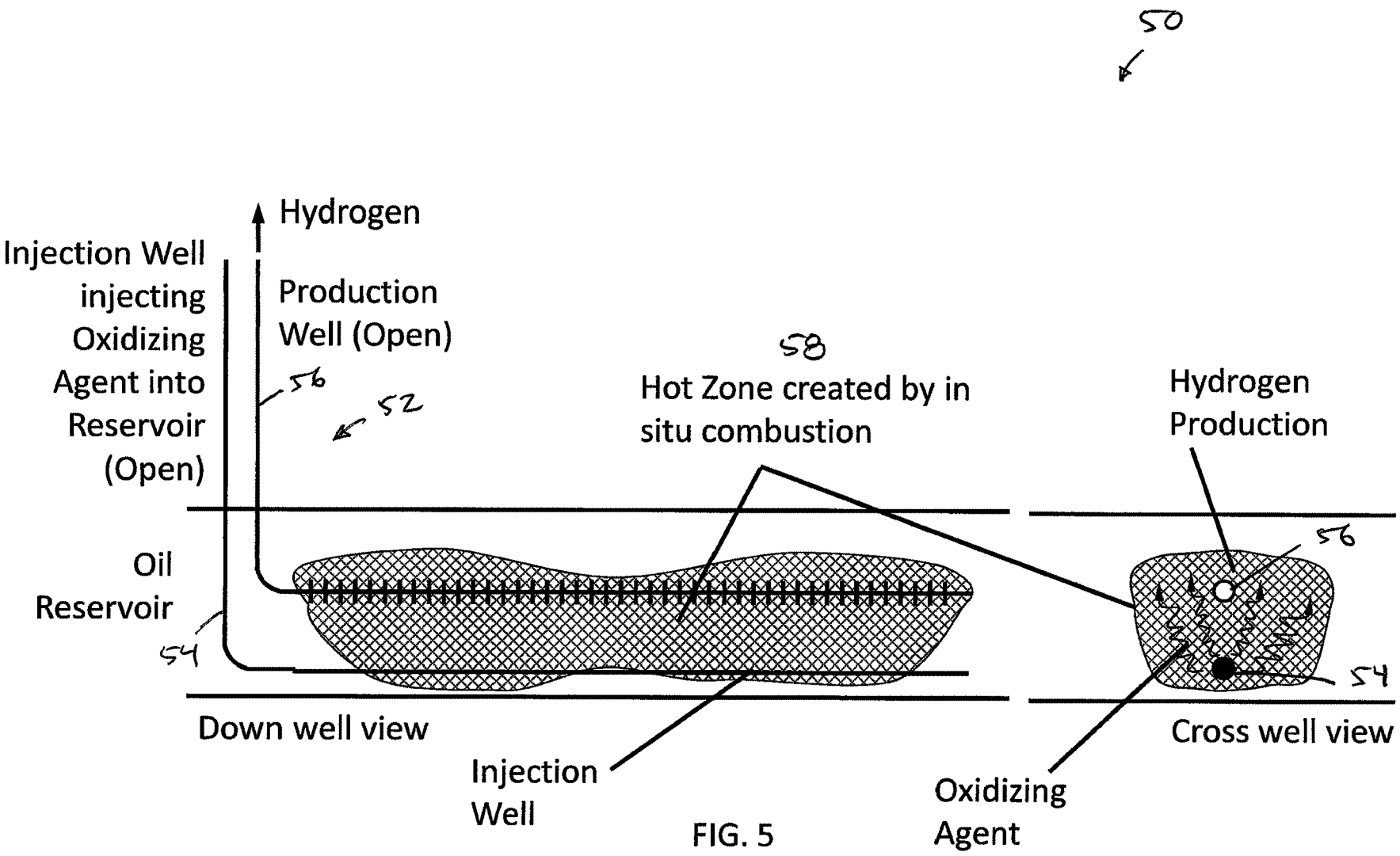
FIG. 5 is a simplified elevation and sectional diagram illustrating an exemplary system and method whereby an oxidizing agent is continuously injected into the reservoir to produce hydrogen.

FIG. 5 illustrates a further exemplary embodiment of a system 50 according to the present invention. Similar to the embodiment of FIG. 1A to 1C, the system 50 comprises a SAGD well pair 52 (an injection well 54 and a production well 56). However, instead of allowing for a post-injection chemical reaction period in the heated zone 58 before production, the injection and production wells 54, 56 remain open and allow a continuous flow of injected oxidizing agent and produced hydrogen. The method may be applied where oil is produced from the reservoir in addition to hydrogen. The method may be applied where synthesis gas is produced from the reservoir.

Figure 6:
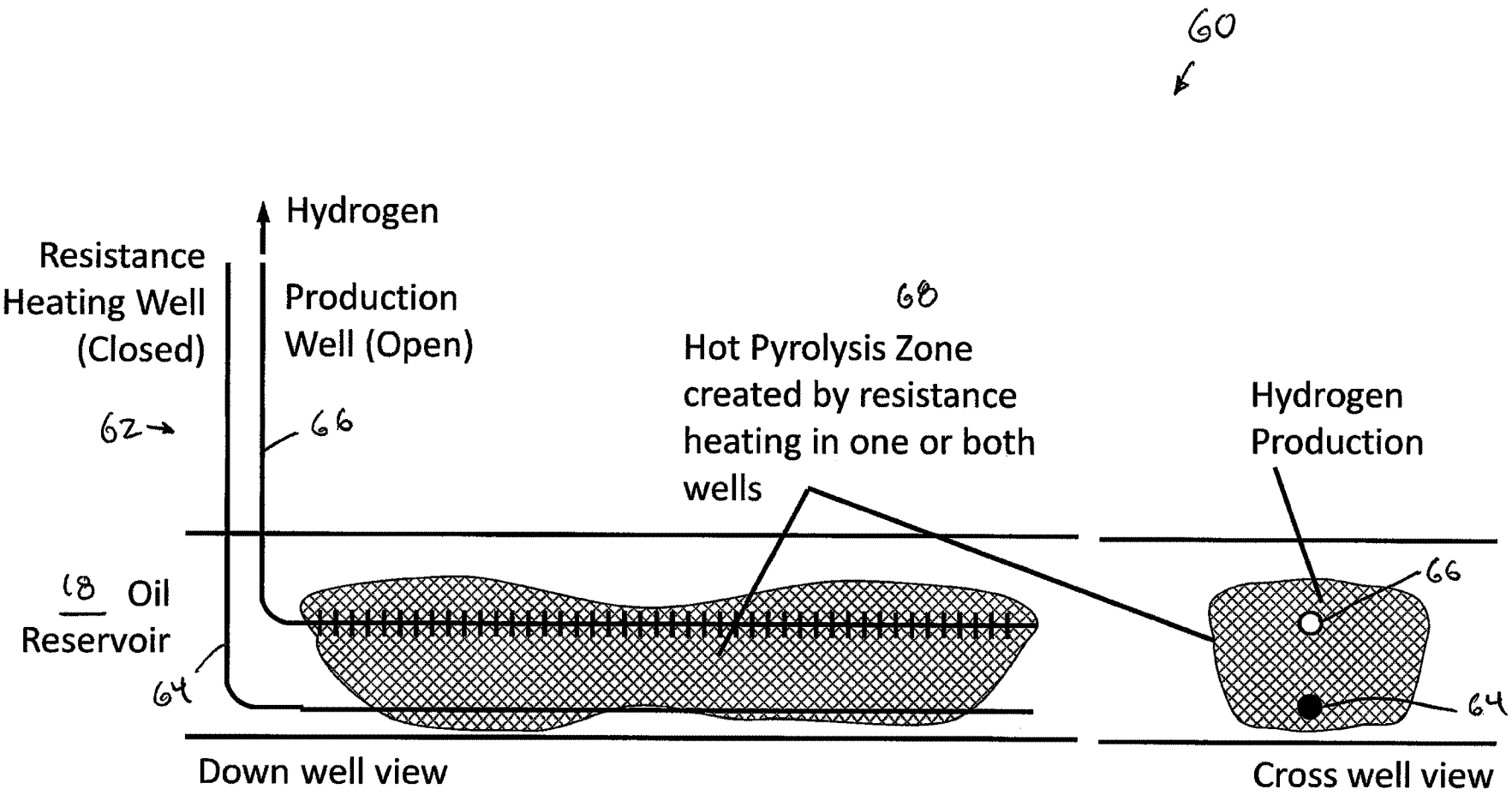
FIG. 6 is a simplified elevation and sectional diagram illustrating an exemplary system and method whereby one of the wells has a resistance-heating cartridge within the well to heat the reservoir to produce hydrogen.

FIG. 6 illustrates a further exemplary embodiment of a system 60 according to the present invention. In this embodiment, comprising a well pair 62 (an injection well 64 and a production well 66), one of the wells 64, 66 is provided with a resistance-heating cartridge which is used to heat a pyrolysis zone 68 in the reservoir 18 to produce hydrogen through the production well 66.

In other embodiments, not illustrated, a single-well configuration could be used wherein oxygen is injected along one part of the well and hydrogen-only production occurs along another part of the well. The well can be vertical, deviated, horizontal or multilateral.

In further non-illustrated embodiments, heating of the reservoir can be done by electromagnetic or radio frequency waves. Alternatively, heating of the reservoir can be done using high pressure, high temperature steam.

The present method can also be used in oil and gas reservoirs where the water content of the reservoir is considered high such that in normal practice, these reservoirs would not be produced for oil or gas, respectively. Methods and system according to the present invention could be used in high water content hydrocarbon reservoirs since hydrogen is sourced not only from the hydrocarbon but also the water within the reservoir. Thus, the methods taught herein may be capable of use in reservoirs where the high water content renders them less valuable than oil saturated reservoirs, converting previously less valuable petroleum reservoirs to valuable energy sources since the hydrogen is sourced from both the petroleum as well as the water in the reservoir.

The present invention relates to treatment of an oil or gas reservoir for production of hydrogen from the hydrocarbon and water within the reservoir. The treatment includes heating the reservoir to enable gasification and water-gas shift reaction to produce hydrogen within the reservoir and then using a hydrogen-only production well, equipped with a hydrogen membrane, to produce hydrogen from the reservoir.

High water content in oil and gas reservoirs is typically thought to be disadvantageous for oil or gas production. However, it has been found that high water content may be a benefit for the production of hydrogen since water supplies hydrogen due to the water-gas shift reaction. It has been found that many of the reactions that produce hydrogen source the hydrogen from the water in the reservoir—under the temperatures of the reactions, the formation water is converted to steam which then participates in the steam reforming reactions with the hydrocarbons in the reservoir.

Following is further detailed description regarding certain exemplary embodiments of the present invention.

A. Heating the Reservoir

In certain exemplary embodiments, the reservoir is heated to a temperature where gasification and water-gas shift reactions take place between the oil and water within the reservoir.

The heat can be delivered to the reservoir through a variety of methods commonly known in the art. Typical methods used in the art include a combustion step where oxygen is injected into the reservoir for a period of time where a portion of the hydrocarbon is combusted to generate heat within the reservoir to achieve temperatures on the order of 400 to 700 degrees C. Other modes of heating including electromagnetic or radio frequency based heating. Other modes of heating include injecting hot materials into the reservoir.

After the heat is injected to the reservoir, if done by combustion, oxygen injection is stopped and the chemical reactions are allowed to continue within the reservoir at the elevated temperature achieved by the combustion step. If heated by electromagnetic heating, then this heating can continue to keep the reservoir at the desired reaction temperature.

B. Gasification, Water-Gas Shift, and Aquathermolysis Reactions Period

During the period of time at the which the reservoir is at elevated temperature, gasification and water-gas shift and aquathermolysis reactions may occur with consequent generation of hydrogen, hydrogen sulphide, carbon monoxide, carbon dioxide, and steam (water vapour), and possibly other gases. As the reactions occur in the reservoir, the gas components collect within the reservoir pore spaces and any fractures or other void spaces in the reservoir.

Figure 7:
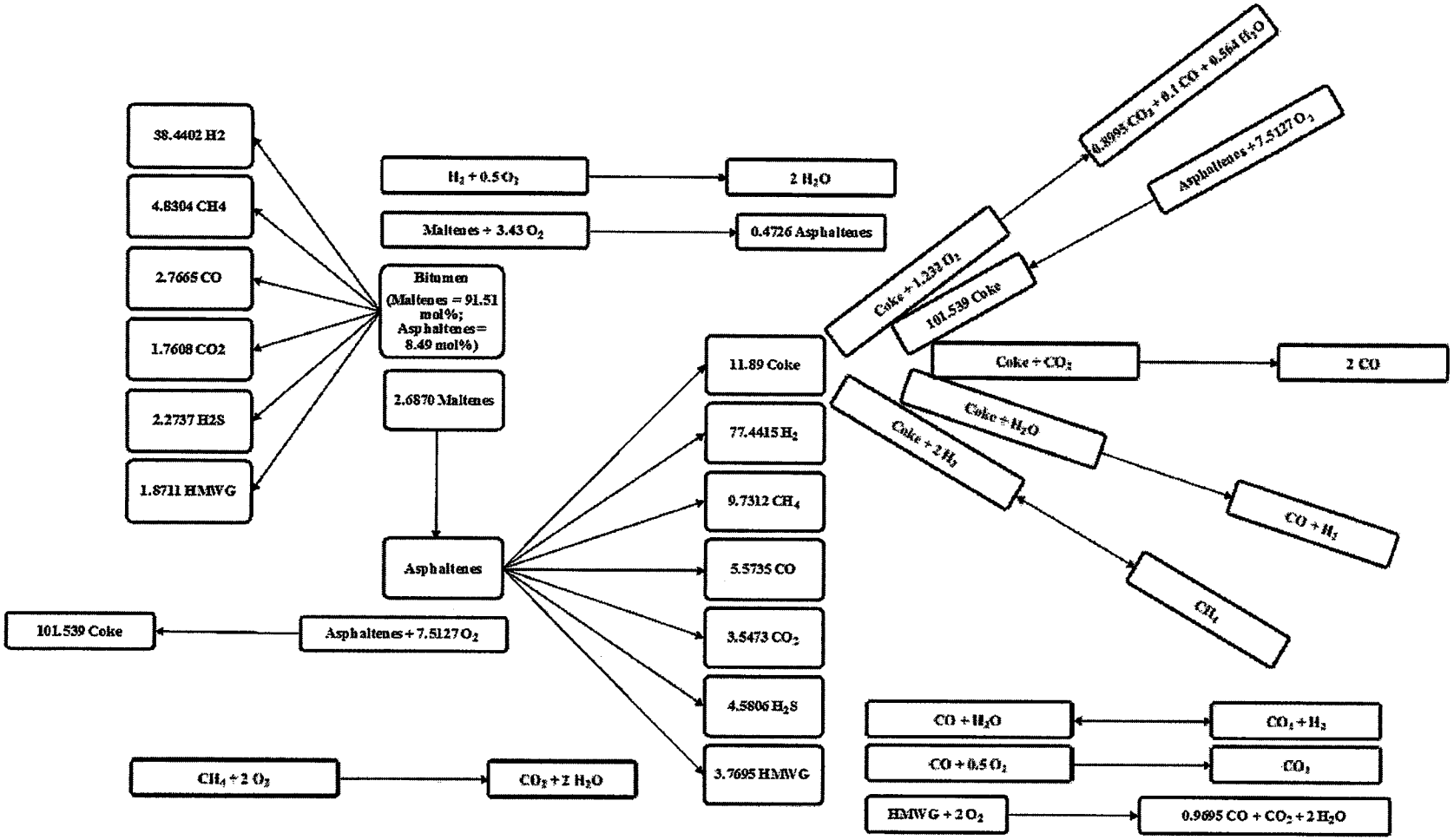
FIG. 7 is a diagram illustrating some of the reactions that occur in the exemplary methods described herein which occur within the reservoir to produce hydrogen.

FIG. 7 illustrates some of the reactions that occur in the reservoir. As can be seen, the fuel for oxidation and gasification is the bitumen and coke that forms from reactions that occur during the process. Bitumen can be represented as a mixture of maltenes (saturates, aromatics, and resins) and asphaltenes (large cyclic compounds with large viscosity). During oxidation, maltenes can be converted into asphaltenes. Asphaltenes can be converted, via both low and high temperature oxidation as well as thermal cracking into a variety of gas products including methane, hydrogen, carbon monoxide, carbon dioxide, hydrogen sulphide, and high molecular weight gases (e.g., propane, etc.) and coke. The coke can then be converted, through oxidation and gasification reactions to methane, water (vapour), carbon monoxide, carbon dioxide, and hydrogen. Also, methane can be converted, via gasification reactions, to hydrogen and carbon dioxide and carbon monoxide. Carbon monoxide and water (vapour) can be converted, via the water-gas shift reaction, to hydrogen and carbon dioxide. In general, fuel components in the system (e.g., oil, coke, methane) can be gasified to produce mixtures of carbon monoxide, carbon dioxide, and hydrogen.

C. Production of Hydrogen

After enough time has elapsed for the generation of hydrogen, the hydrogen is produced from the reservoir through the hydrogen-only membranes within the production well. In this manner, the hydrogen sulphide, carbon monoxide, carbon dioxide, steam, and other gas components remain in the reservoir while the hydrogen alone is produced to surface. Since hydrogen is removed from the reservoir, this promotes the reactions to generate more hydrogen.

For the hydrogen-only membrane to be placed in the production well, metallic membranes, for example, constructed from palladium (Pd), vanadium (V), tantalum (Ta) or niobium (Nb), are mechanically robust but with limited ranges of optimal performance with respect to temperature. These membranes work by a solubility-diffusion mechanism, with the hydrogen dissolving in the membrane material and diffusing to the other side where it is released; this mechanism yields hydrogen flux (moles transport rate per unit area) proportional to the square root of the pressure. To illustrate, vanadium and titanium permeability to hydrogen drops at high temperatures and also forms metal oxide layers that prevent efficient hydrogen separation. Pd-based membranes have the advantage since their hydrogen permeability rises with increasing temperature. However, Pd membranes are poisoned by hydrogen sulfide (H2S) and carbon monoxide (CO) which are created by aquathermolysis when steam and oil, e.g. bitumen, are contacted at elevated temperatures. This can be countered by using Pd-Copper alloys. For cost reduction, multilayer membranes consisting of Pd—Cu alloy and V, Ta, and Nb could be constructed. Other alloys such as palladium-silver alloys may also be useful for certain embodiments of the present invention.

Ceramic membranes are inert to H2S and CO and can be used at temperatures achieved by in situ gasification processes. Microporous ceramic membranes for hydrogen separation have several advantages over metallic membranes: the flux is directly proportional to the pressure; the permeability of ceramic microporous membranes rises significantly with temperature; and the cost of the raw materials for ceramic membranes is much less than that of metallic membranes. Since they are porous, they tend not to produce pure hydrogen although they can be hydrogen-selective with relatively high hydrogen permeability. In some embodiments, the membrane can have a ceramic layer to not only provide ability to separate hydrogen from gas components generated from the reactions but to also strengthen the membrane.

In some embodiments, the hydrogen membrane is configured to be highly selective to hydrogen (especially if the hydrogen gas is to be used for power generation from a fuel cell at surface), highly permeable to hydrogen, capable of withstanding heating up to 700 degrees C., able to withstand H2S and CO gas, robust mechanically given the issues of placing the membranes in the well, and/or capable of being manufactured with diameters and lengths that can fit in wells (between 20-30 cm in diameter and 700-1000 m in length). In some embodiments, the membranes can also withstand the partial oxidation stage which will consume carbon and other solid buildup on the exterior surface of the composite membrane.

Figure 4A:
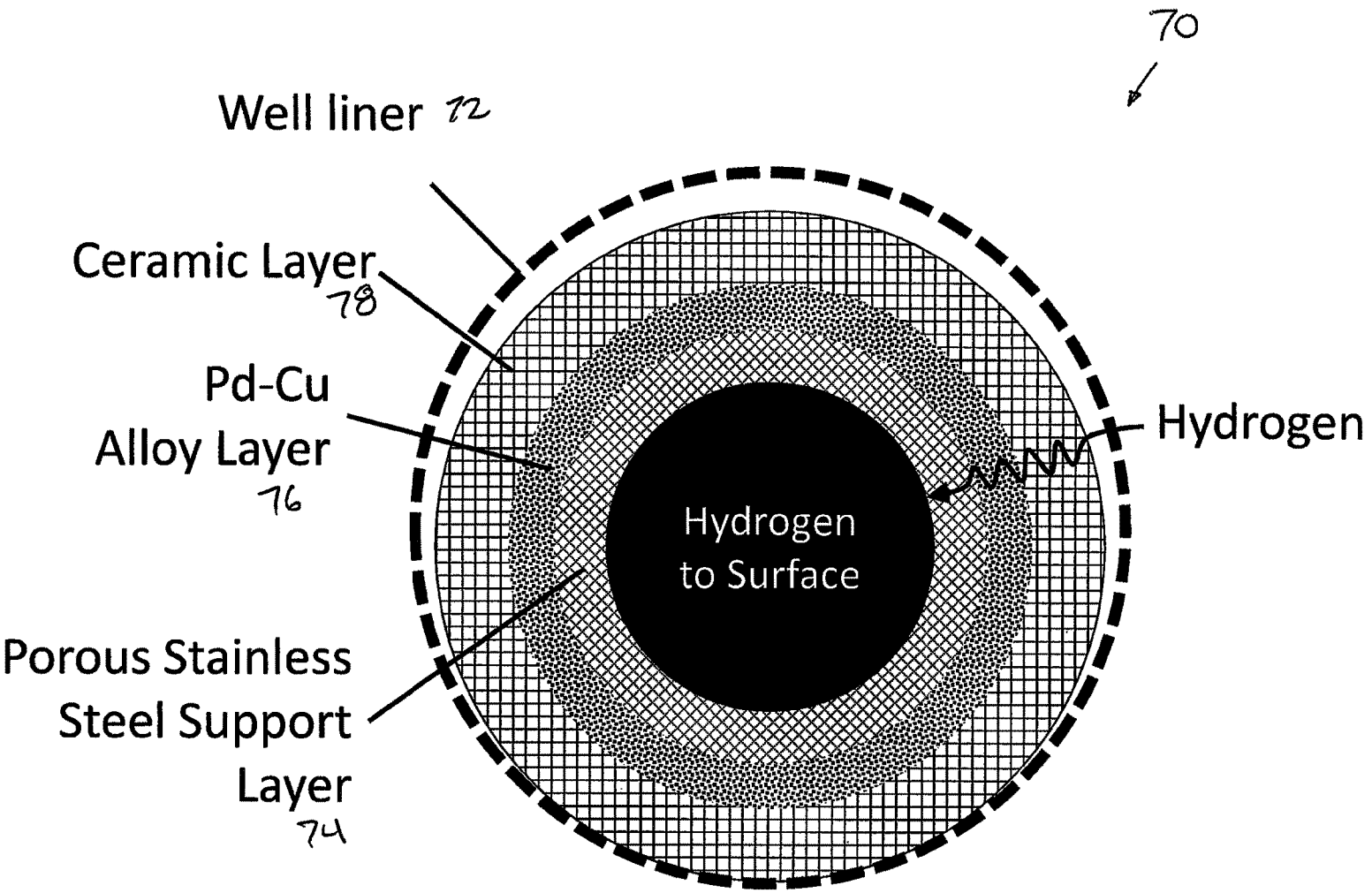
FIG. 4A to 4C are sectional views illustrating exemplary hydrogen-separating composite membranes.
Figure 4B:
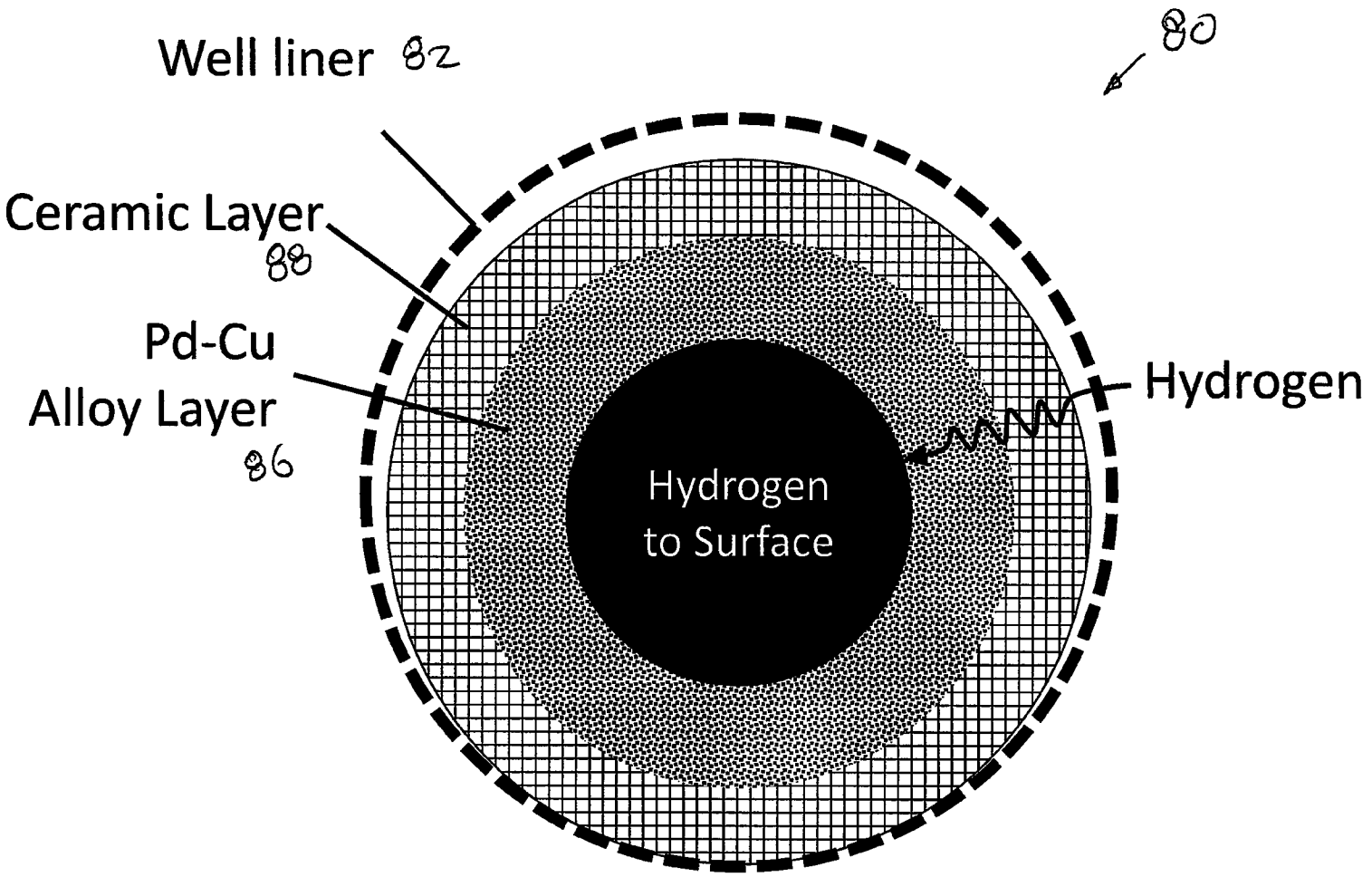
Figure 4C:
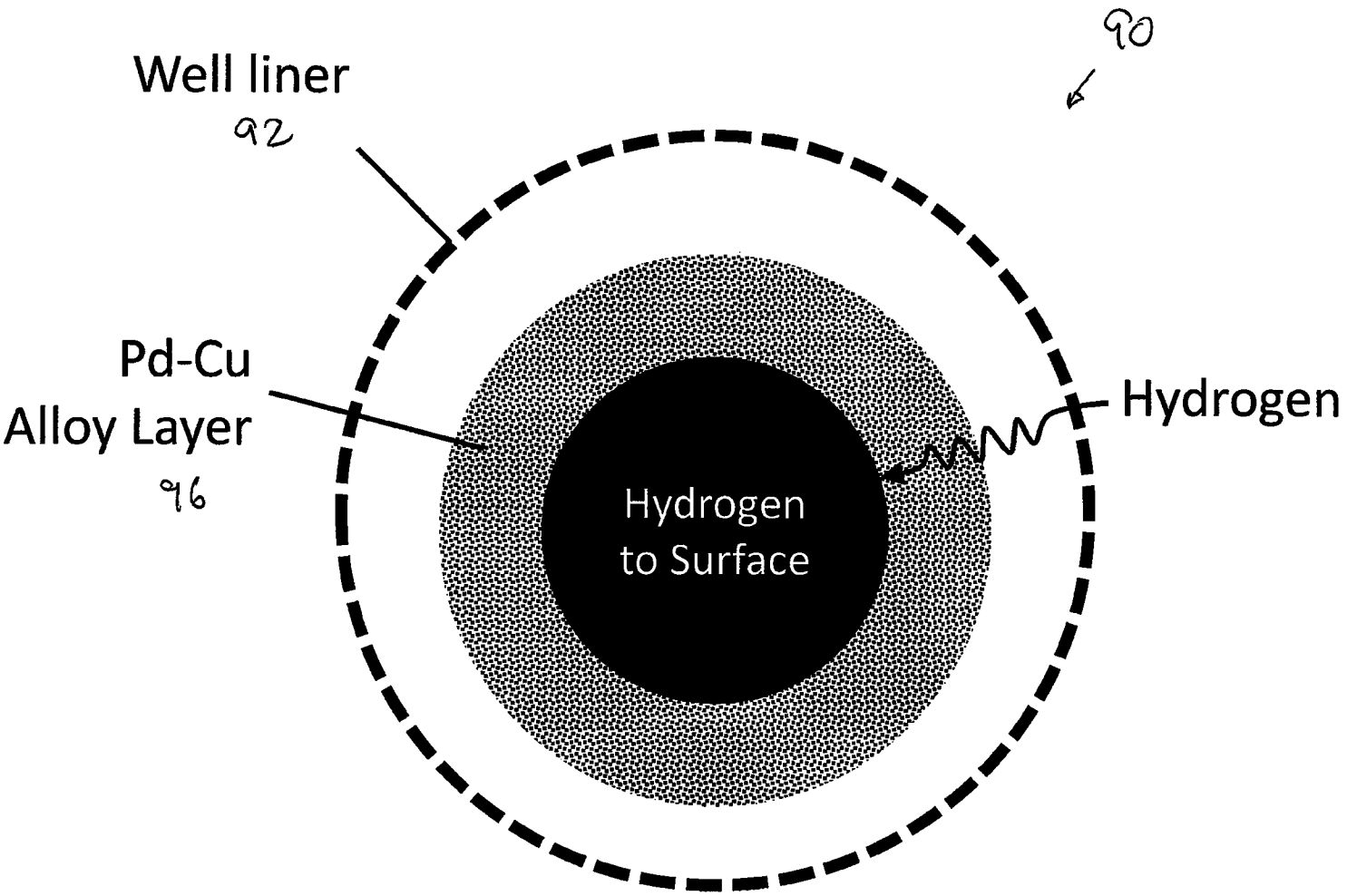

Turning now to FIG. 4A to 4C, exemplary embodiments of membranes according to the present invention are illustrated. FIG. 4A illustrates a membrane arrangement 70, wherein the arrangement 70 is located within a well liner 72. The arrangement 70 comprises a porous steel support layer 74, an overlying Pd—Cu alloy layer 76, and an outer ceramic layer 78. In FIG. 4B, the support layer is absent and the arrangement 80 comprises an inner alloy layer 86 and an outer ceramic layer 88 disposed within the well liner 82. FIG. 4C illustrates an arrangement 90 comprising only an alloy layer 96 in a well liner 92.

D. New Cycle

If the heating is done in a cyclic manner, for example, from in situ combustion, then after the temperature of the reservoir has dropped such that the gasification, water-gas shift, and aquathermolysis reaction rates have dropped so that hydrogen production drops below a threshold value, then a new cycle of oxygen injection and consequent in situ combustion will start leading to renewed heating of the reservoir. Thereafter, Steps A to C above are repeated. If continuous heating is done by oxidization agent injection or electromagnetic or radio frequency or resistive heating methods, then continuous hydrogen production can occur from the reservoir.

EXAMPLES

Figure 8A:
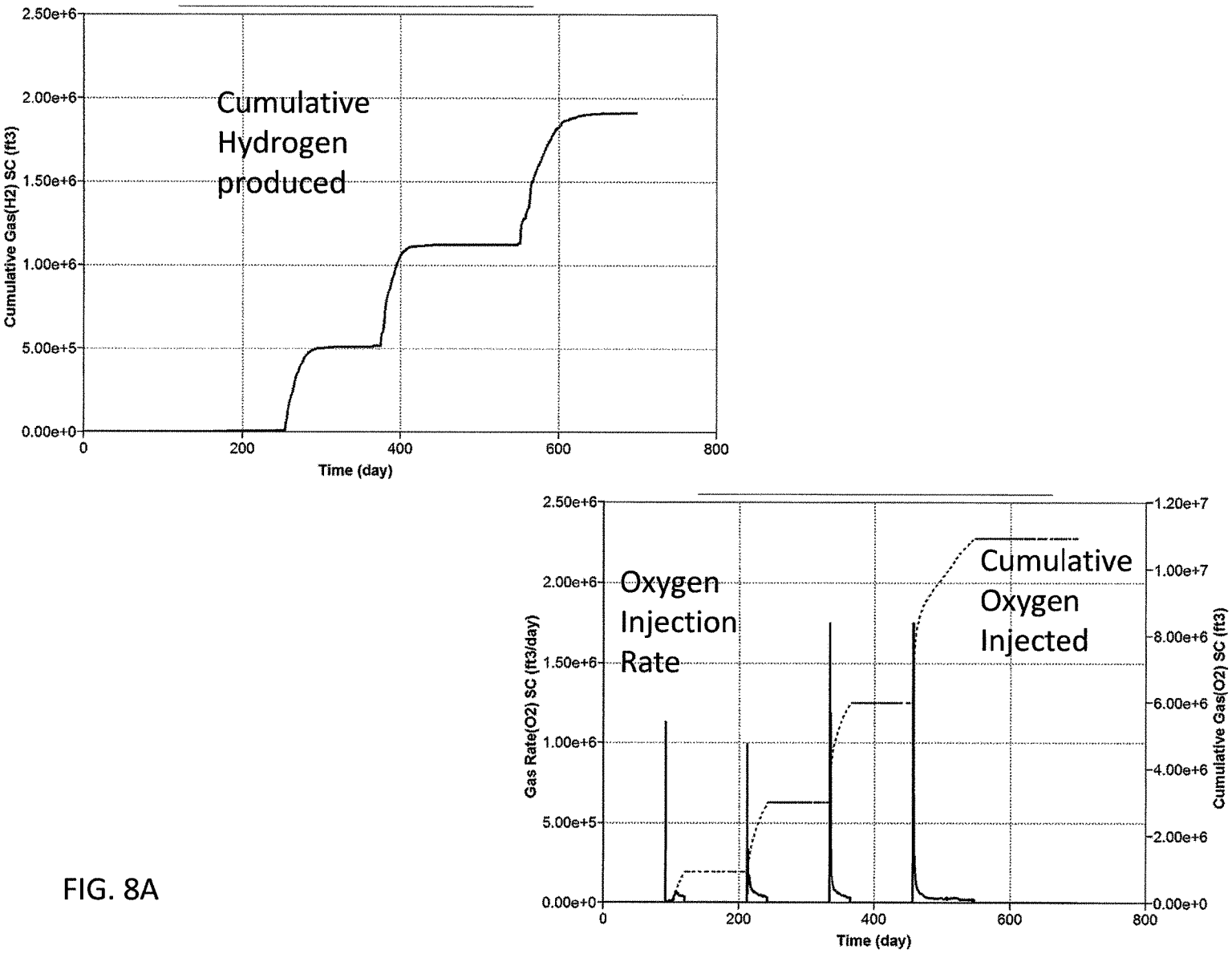
FIG. 8A to 8B are diagrams illustrating results of a thermal reactive reservoir simulation, using the reaction scheme illustrated in FIG. 7, of a hydrogen production process in a heavy oil reservoir comprising a cyclic oxidizing agent injection process including periods of non-injection where chemical reactions are allowed to continue within the reservoir.
Figure 8B:
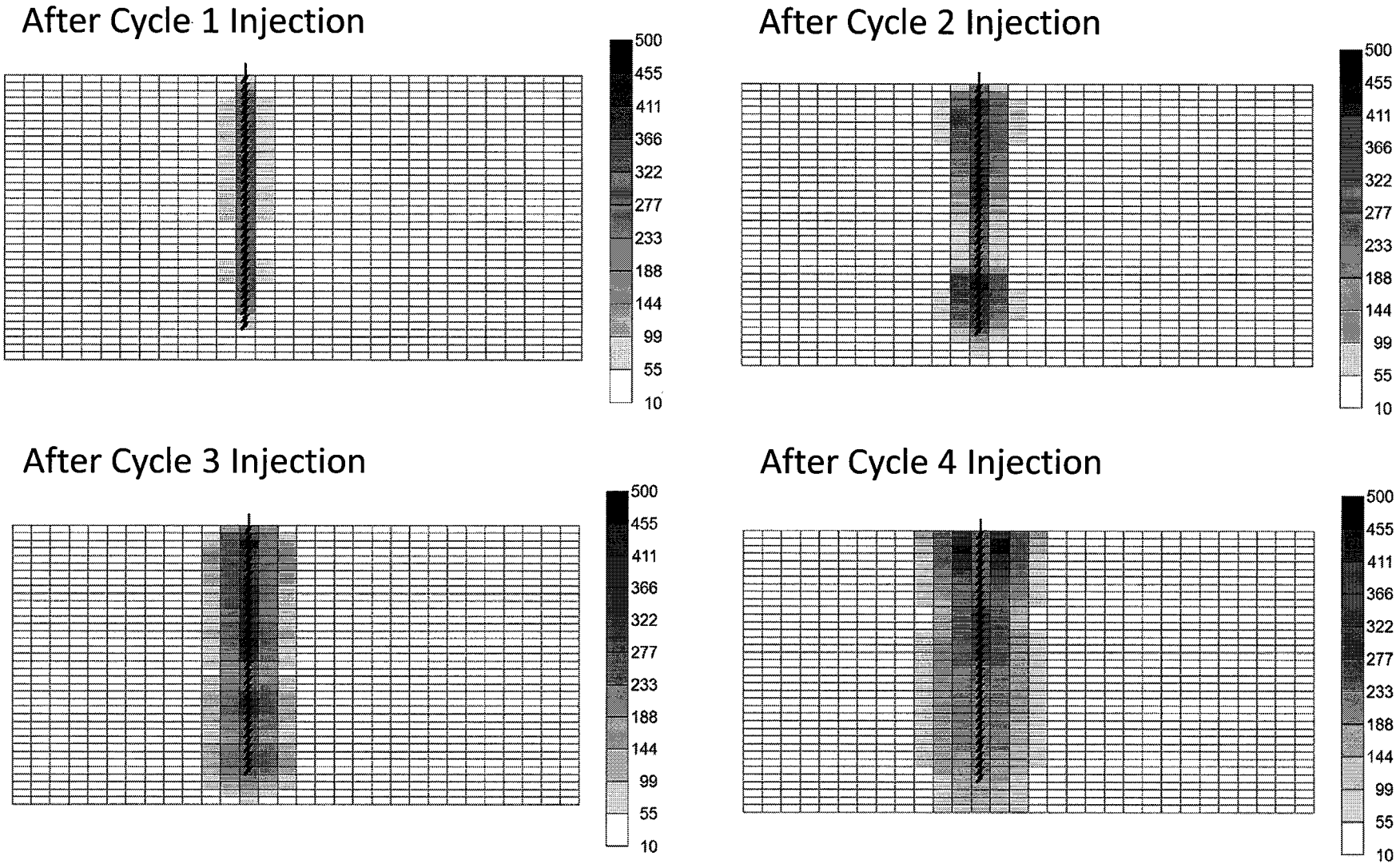

FIG. 8A to 8B illustrate results of a first thermal reactive reservoir simulation conducted using the CMG STARS™ reservoir simulation software (a software product that is the industry standard for thermal reactive reservoir production process simulation—it solves energy and material balances in the context of phase equilibrium and Darcy flow within porous media) for a cyclical process according to the present invention. In this case, a single vertical well is used for both injection and production within the reservoir. In this example, the operation is done cyclically where oxygen is injected for a period of time after which it is shut in and then it is opened for production for a period after which it is shut in. This cycle of injection and production is repeated until the overall process is no longer productive at predetermined levels. The reservoir properties used in this three-dimensional reservoir simulation model has properties typical of that of an oil sands reservoir (porosity 0.3, horizontal permeability 2200 mD, vertical permeability 1100 mD, thickness 37 m, oil saturation 0.7, initial pressure 2800 kPa, initial temperature 13 degrees C., initial solution gas gas-to-oil ratio 10 $m^3/m^3$). In the model the reaction scheme illustrated in FIG. 7 is used. FIG. 8A shows that on injection of oxygen in a cyclic manner, hydrogen is generated in the reservoir via the reactions described in FIG. 7. FIG. 8B displays the temperature distributions in the vertical plane of the injection/production well. The results show that the temperature reaches as high as 500 degrees C. in the reservoir surrounding the vertical well after the injection of oxygen into the reservoir. As a consequence of this temperature rise, the reactions described in FIG. 7 occur with consequent generation of hydrogen in the reservoir. After the oxygen injection step is complete, the well is converted to production mode and the hydrogen alone is produced from the reservoir. The cycles are continued until the amount of hydrogen produced per cycle is no longer economic.

FIG. 9A to 9D illustrates the results of a second simulation using the CMG STARS™ reservoir simulation software, for an exemplary embodiment of the present invention wherein a lower injection well is placed in the reservoir near the base of the reservoir and an upper production well is placed above the injection well. In this case, the production well is inclined within the reservoir, as can best be seen in FIG. 9A. In this example, the length of the injection well is equal to 105 m. The reservoir properties used in this three-dimensional reservoir simulation model has properties typical of that of an oil sands reservoir (porosity 0.3, horizontal permeability 2200 mD, vertical permeability 1100 mD, thickness 37 m, oil saturation 0.7, initial pressure 2800 kPa, initial temperature 13 degrees C., initial solution gas gas-to-oil ratio 10 $m^3/m^3$). In the model the reaction scheme illustrated in FIG. 7 is used.

Figure 9A:
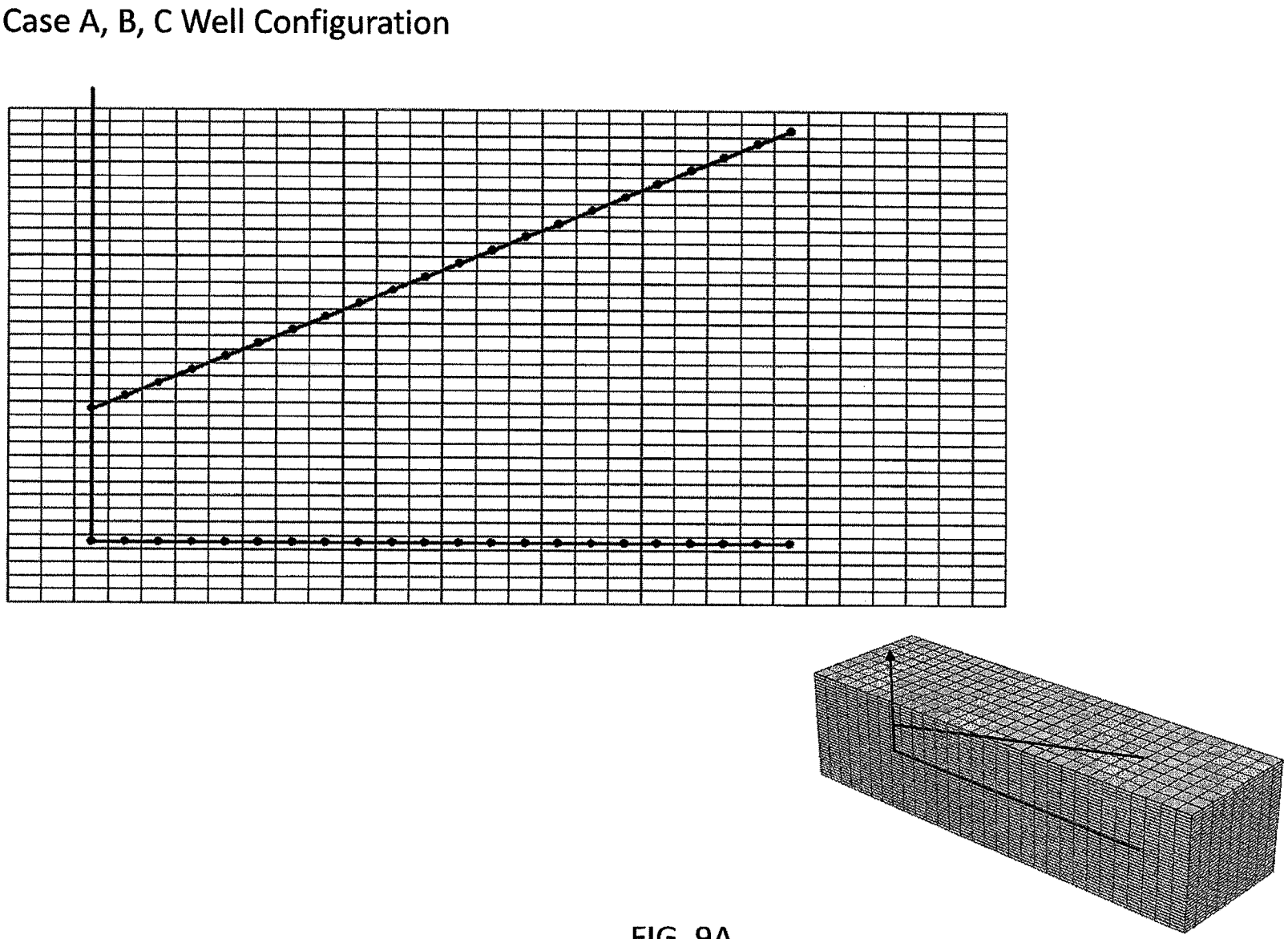
FIG. 9A to 9D are diagrams illustrating results of a thermal reactive reservoir simulation, using the reaction scheme illustrated in FIG. 7, of a hydrogen production process in a heavy oil reservoir comprising a continuous oxidizing agent injection process.
Figure 9B:
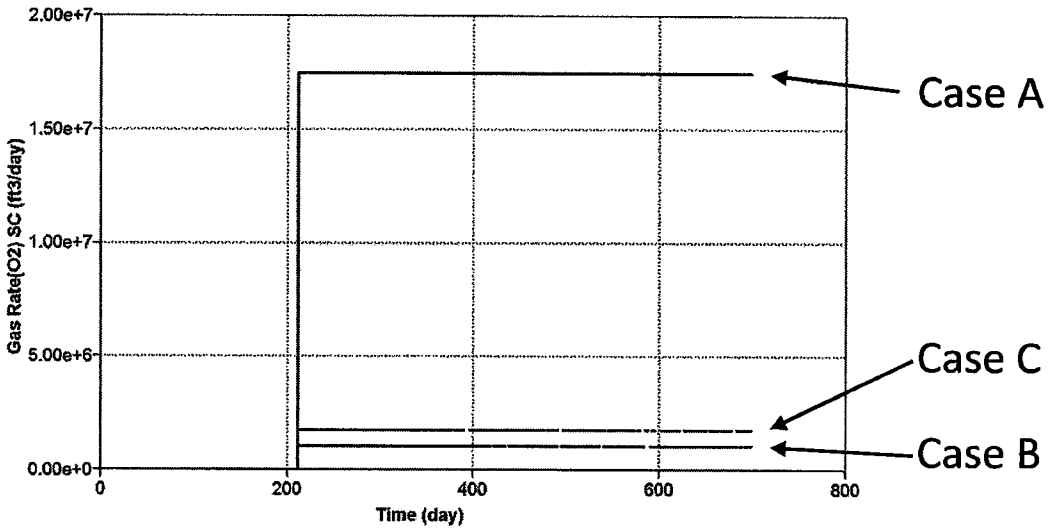

FIG. 9B illustrates operations where three different flow rates of oxygen are injected into the reservoir. In Cases A, B, and C, the oxygen injection rates are 17.5, 1.05, and 1.75 million scf/day, respectively.

Figure 9C:
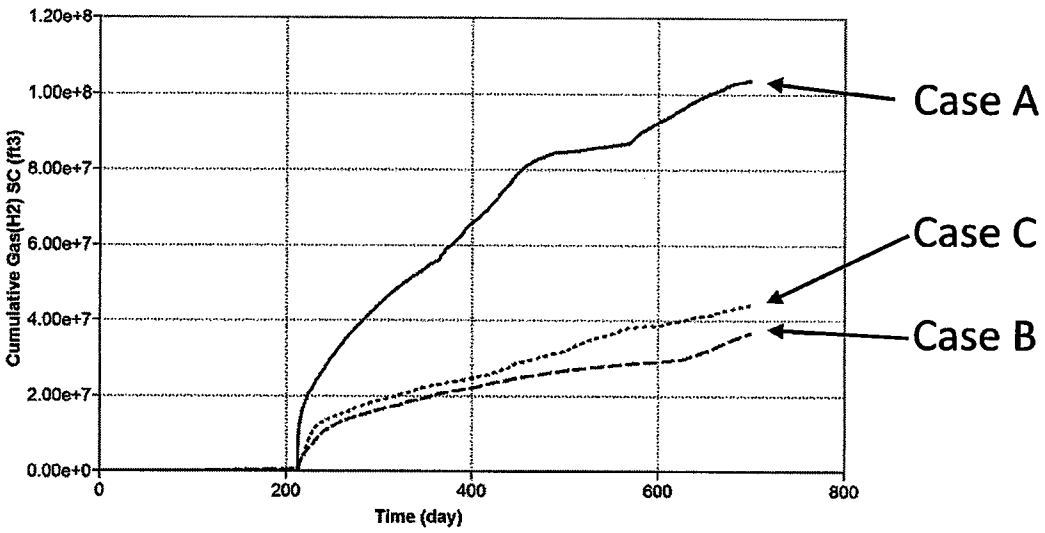

FIG. 9C shows the resulting hydrogen production volumes from the reservoir corresponding to Cases A, B, and C. The cumulative volumes of hydrogen produced after 700 days of operation are 104, 37, and 44 million scf of hydrogen.

Figure 9D:
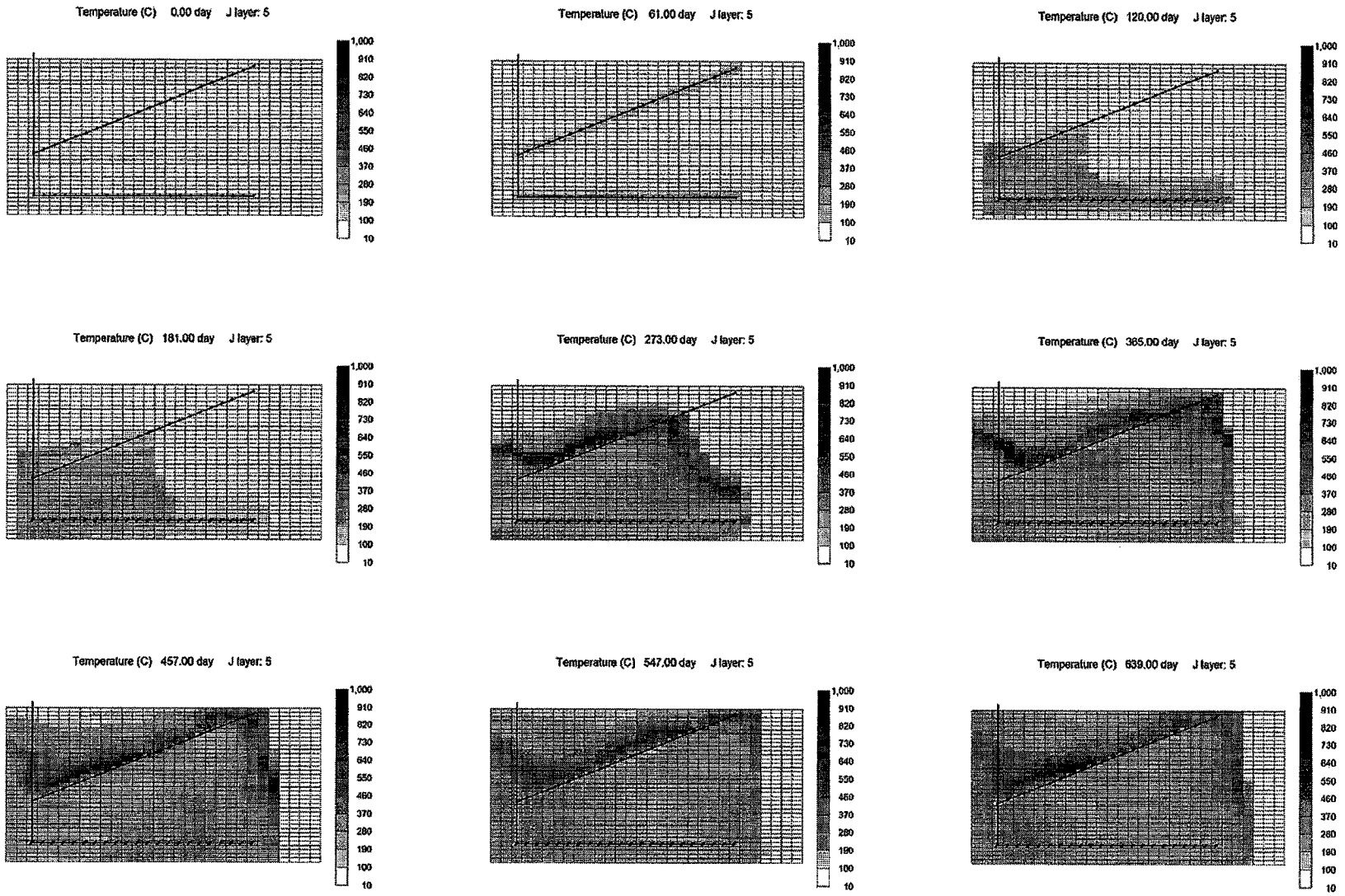

FIG. 9D presents an example of the temperature distributions in the horizontal-vertical plane of the injection and production wells for Case A. The results show that as oxygen is injected into the reservoir, a reactive zone is created within the reservoir. The reactive zone is characterized by the zone with temperature that is higher than the original reservoir temperature. The results demonstrate that the temperature rises above 450 degrees C. and at the reaction front, the temperature reaches as high as 900 degrees C. With temperatures more than 400 degrees C., gasification reactions occur within the hot zone which generate hydrogen which is exclusively produced by the upper production well to the surface. Within the hot zone around the injection well, heated oil drains and accumulates around the injection well thus supplying more fuel for the reactions that occur around the injection well.

The above examples illustrate exemplary methods of conducting in situ gasification reactions within a reservoir where a membrane is used in the production well to produce hydrogen to the surface.

The hydrogen generated from the methods taught here can be used in fuel cells at surface to generate power, or combusted to produce steam which can be used to generate power or for other in situ oil recovery processes, or sold as industrial feedstock.

As will be clear from the above, those skilled in the art would be readily able to determine obvious variants capable of providing the described functionality, and all such variants and functional equivalents are intended to fall within the scope of the present invention.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Specific examples of methods and systems have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A method for producing hydrogen from a petroleum reservoir, the method comprising:

a. providing a well from surface to the reservoir;

b. locating in the well at least one hydrogen-permeable membrane;

c. heating the reservoir to facilitate at least one of gasification, water-gas shift, and aquathermolysis reactions to occur between petroleum hydrocarbons and water within the reservoir to generate a gas stream comprising hydrogen; and d. allowing the gas stream to enter the well and engage the at least one hydrogen-permeable membrane, such that the at least one hydrogen-permeable membrane permits passage of only the hydrogen in the gas stream to the surface.

2. The method of claim 1 wherein the step of heating the reservoir comprises injecting an oxidizing agent into the reservoir to oxidize at least some of the petroleum hydrocarbons within the reservoir.

3. The method of claim 1 wherein the step of heating the reservoir comprises generating electromagnetic or radio-frequency waves with an electromagnetic antenna or radio-frequency antenna placed within the reservoir.

4. The method of claim 3 wherein dielectric heating is used for the step of heating the reservoir, where electromagnetic radiation has a frequency in the range of about 60 Hz to 1000 GHz.

5. The method of claim 1 wherein the step of heating the reservoir comprises injecting a hot material into the reservoir.

6. The method of claim 1 wherein the step of heating the reservoir comprises generating heat by using a resistance-based (ohmic) heating system located within the reservoir.

7. The method of claim 6 wherein the resistance-based (ohmic) heating system is used to heat the reservoir to temperatures in the range of 200 to 800 degrees C.

8. The method of claim 1, wherein the at least one hydrogen-permeable membrane comprises at least one of: palladium (Pd), vanadium (V), tantalum (Ta) or niobium (Nb).

9. The method of claim 1 wherein the at least one hydrogen-permeable membrane comprises a palladium-copper alloy.

10. The method of claim 1, comprising the further step, after the step of heating the reservoir, of delaying engaging the gas stream and the at least one hydrogen-permeable membrane to allow for further generation of the hydrogen.

11. The method of claim 10 wherein the step of delaying comprises delaying for a period in the range of 1 week to 12 months.

* * * * *